US009883695B2

(12) United States Patent
Akiyama et al.

(10) Patent No.: US 9,883,695 B2
(45) **Date of Patent: *Feb. 6, 2018**

(54) FLAVOR INHALER

(71) Applicant: JAPAN TOBACCO INC., Tokyo (JP)

(72) Inventors: Takeshi Akiyama, Tokyo (JP); Tomohiro Kobayashi, Tokyo (JP); Manabu Yamada, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 510 days.

This patent is subject to a terminal disclaimer.

(21) Appl. No.: 14/499,862

(22) Filed: Sep. 29, 2014

(65) Prior Publication Data

US 2015/0013703 A1 Jan. 15, 2015

Related U.S. Application Data

(63) Continuation of application No. PCT/JP2013/059141, filed on Mar. 27, 2013.

(30) Foreign Application Priority Data

Mar. 30, 2012 (JP) ..... 2012-083184

(51) Int. Cl.
*A24F 47/00* (2006.01)
*A24B 15/16* (2006.01)
(Continued)

(52) U.S. Cl.
CPC ..... *A24F 47/006* (2013.01); *A24B 15/165* (2013.01); *A24D 1/002* (2013.01);
(Continued)

(58) Field of Classification Search
CPC ..... A24F 47/004; A24F 47/006
See application file for complete search history.

(56) References Cited

U.S. PATENT DOCUMENTS 4,854,331 A * 8/1989 Banerjee ..... A24B 15/165 128/202.21
4,881,556 A 11/1989 Clearman et al.
(Continued)

FOREIGN PATENT DOCUMENTS

CN 87101955 A 2/1988
CN 1040496 A 3/1990
(Continued)

OTHER PUBLICATIONS

Office Action issued in corresponding Taiwanese Application No. 102111364 dated Jul. 14, 2016 (with English translation).
(Continued)

*Primary Examiner* — Eric Yaary
(74) *Attorney, Agent, or Firm* — Birch, Stewart, Kolasch & Birch, LLP

(57) ABSTRACT

A carbon heat source (10) is equipped with: a cylindrical section (11) provided with a cavity (11A) through which there is ventilation communication in the longitudinal axis direction (L) of the carbon heat source (10); and an ignition end (12) which is provided further to the ignition side of the carbon heat source (10) than the cylindrical section (11). Therein, a groove (12A) which connects with the cavity (11A) is formed on the end surface (E) of the ignition side of the ignition end (12).

12 Claims, 9 Drawing Sheets

(51) Int. Cl.
*A24D 1/00* (2006.01)
*A24D 1/02* (2006.01)
*C10L 5/36* (2006.01)

(52) U.S. Cl.
CPC ..... *A24D 1/027* (2013.01); *C10L 5/36* (2013.01); *C10L 2270/08* (2013.01)

(56) References Cited

U.S. PATENT DOCUMENTS

| | | | | |
|---|---|---|---|---|
| 4,881,566 | A | 11/1989 | Ubels et al. | |
| 4,989,619 | A * | 2/1991 | Clearman ..... | A24B 15/165 131/194 |
| 5,020,548 | A | 6/1991 | Farrier et al. | |
| 5,027,837 | A | 7/1991 | Clearman et al. | |
| 5,040,552 | A | 8/1991 | Schleich et al. | |
| 5,076,297 | A | 12/1991 | Farrier et al. | |
| 5,156,170 | A | 10/1992 | Clearman et al. | |
| 5,159,940 | A | 11/1992 | Hayward et al. | |
| 5,183,062 | A | 2/1993 | Clearman et al. | |
| 5,247,947 | A | 9/1993 | Clearman et al. | |
| 8,061,361 | B2 | 11/2011 | Maeder et al. | |
| 2007/0023056 | A1 * | 2/2007 | Cantrell ..... | A24F 47/004 131/194 |
| 2009/0044818 | A1 | 2/2009 | Takeuchi et al. | |
| 2012/0080042 | A1 | 4/2012 | Nishimura et al. | |

FOREIGN PATENT DOCUMENTS

| | | | |
|---|---|---|---|
| CN | 1043250 | A | 6/1990 |
| CN | 1059841 | A | 4/1992 |
| CN | 101420876 | A | 4/2009 |
| EP | 0372985 | A2 | 6/1990 |
| EP | 0444553 | A2 | 9/1991 |
| EP | 0472367 | A1 | 2/1992 |
| EP | 2550879 | A1 | 1/2013 |
| JP | 5-103836 | A | 4/1993 |
| JP | 2010-535530 | A | 11/2010 |
| TW | 147815 | | 12/1990 |
| WO | WO 2010/146693 | A1 | 12/2010 |
| WO | WO 2011/139730 | A1 | 11/2011 |
| WO | WO 2012/014490 | A1 | 2/2012 |

OTHER PUBLICATIONS

Office Action issued in corresponding EP Application No. 13 769 640.7 dated Oct. 18, 2016.

Office Action issued in corresponding Japanese Patent Application No. 2014-507987 dated Sep. 15, 2015 (with English tranlation).

Taiwanese Office Action, dated Jan. 8, 2016, for corresponding Taiwanese Application No. 102111364, with an English translation.

European Patent Office, "Communication with Extended Search Report," issued in connection with European Patent Application No. 16187680.0, dated Feb. 22, 2017.

Chinese Office Action and Search Report, dated May 5, 2017, for Chinese Application No. 201610766099.5, with an English translation of the Office Action only.

European Office Action, dated Aug. 25, 2017, for European Application No. 13769640.7.

* cited by examiner

FIG. 8

| SAMPLE | OUTER DIAMETER OF HS | CAVITY CONDITIONS | | | | MOLDED BODY CROSS-SECTIONAL AREA | FLOW CHANNEL PERIMETER | MOLDED BODY CROSS-SECTIONAL AREA/FLOW PATH PERIMETER (INDEX) | TEMPERATURE DIFFERENCE BETWEEN PUFFS | BURNING CONTINUED PUFF NUMBER | SHAPE IMAG |
|---|---|---|---|---|---|---|---|---|---|---|---|
| | | CAVITY 1 | | CAVITY 2 | | | | | | | |
| | | DIAMETER | QUANTITY | DIAMETER | QUANTITY | | | | | | |
| | [mm] | [mm] | [QUANTITY] | [mm] | [QUANTITY] | [mm2] | [mm] | [mm] | [°C] | [NUMBER] | |
| SAMPLE L-1 | 6.0 | 1.0 | 1 | - | - | 27.5 | 3.1 | 8.75 | 41.1 | 7.0 | 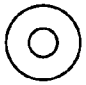 |
| SAMPLE L-2 | 6.0 | 1.7 | 1 | - | - | 26.0 | 5.3 | 4.87 | 32.9 | 6.0 | |
| SAMPLE L-3 | 6.0 | 2.7 | 1 | - | - | 22.5 | 8.5 | 2.66 | 61.8 | 5.0 | |
| SAMPLE M-1 | 6.0 | 1.9 | 1 | 1 | 8 | 19.2 | 31.1 | 0.62 | 144.5 | 3.0 | 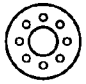 |
| SAMPLE M-2 | 6.0 | 1.0 | 8 | - | - | 22.0 | 25.1 | 0.88 | 238.1 | 4.0 | 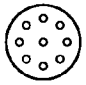 |

FLAVOR INHALER

TECHNICAL FIELD

The present invention relates to a carbon heat source and a flavor inhaler.

BACKGROUND ART

Various proposals have been made for a flavor inhaler provided with a carbon heat source and configured to heat a flavor generating source by the heat generated by the carbon heat source.

For example, Patent Literature 1 discloses a flavor inhaler having a carbon heat source provided with a ridge groove on an ignition surface (an end face on an ignition side) across the ignition surface for improving ignitability.

Patent literature 2 discloses a flavor inhaler having a columnar carbon heat source that is provided with a through-hole with a diameter of 1.5 mm to 3 mm.

A carbon heat source used in a flavor inhaler preferably satisfies the following conditions.

The first condition is to provide good ignitability and sufficient heat in a period from a start of burning to an initial puff (smoking).

The second condition is to supply a stable amount of heat with less fluctuation in calorific value in a period of middle to late of a puff (smoking).

The carbon heat source disclosed in the Patent Literature 1 can improve the ignitability in the period from the start of burning to the initial puff by the groove provided on the ignition surface. However, it merely increases a contact area of an ignition source such as a lighter and an ignition end portion, and an air flow path is not configured to transmit heat efficiently to the ignition end portion in the period from the start of burning to the initial puff. Thus, the effect is insufficient.

Further, the carbon heat source disclosed in the Patent Literature 1 is assumed to be used in a flavor inhaler configured to transmit the heat generated by a carbon heat source to a flavor generating source via an enclosing member or a holding member of the carbon heat source. Thus, when used in a flavor inhaler configured to transmit the heat generated by a carbon heat source to a flavor generating source mainly by convection heat transfer, there is a problem that the supply of stable amount of heat is difficult in the period of middle to late of the puff (smoking).

The carbon heat source disclosed in the Patent Literature 2 has a uniform circular column shape over the entire length, that is, a groove or the like is not provided on an ignition surface. Thus, there is a problem that efficient heat transfer to an ignition surface is difficult in an ignition source such as a commercially available lighter or the like, and good ignitability is difficult in a period from a start of burning to an initial puff.

In a conventional integrally molded carbon heat source as disclosed in the Patent Literatures 1 and 2, it is very difficult to achieve both good ignitability in a period from a start of burning to an initial puff and supply of stable amount of heat in a period of middle to late of a puff (smoking).

CITATION LIST

Patent Literature

Patent Literature 1: Japanese Patent Application Publication No. H5-103836

Patent Literature 2: Japanese Patent Application Publication No. 2010-535530

SUMMARY OF THE INVENTION

A columnar carbon heat source of a first feature comprises: a cylindrical portion provided with a cavity for ventilating and communicating in a longitudinal axis direction of the carbon heat source; and an ignition end portion provided on an ignition side of the carbon heat source than the cylindrical portion. A groove communicating with the cavity is formed on an end face of the ignition end portion on the ignition side. The ignition end portion has a void that communicates with the cavity in an extending direction of the cavity provided in the cylindrical portion. The groove is formed separately from the void.

In the first feature, the groove is exposed to a side surface of the ignition end portion.

In the first feature, the cylindrical portion has a circular cylinder shape. A difference between a diameter of the cavity and an outer diameter of the carbon heat source is configured to be 1 mm or more.

In the first feature, the cylindrical portion and the ignition end portion are integrally molded.

In the first feature, a size of the carbon heat source is configured to be 10 mm to 30 mm in the longitudinal axis direction of the carbon heat source. A size of the carbon heat source is configured to be 4 mm to 8 mm in a direction orthogonal to the longitudinal axis direction.

In the first feature, a size of the cavity is configured to be 1 mm to 4 mm in a direction orthogonal to the longitudinal axis direction of the carbon heat source.

A flavor inhaler of a second feature comprises the carbon heat source of the first feature.

BRIEF DESCRIPTION OF DRAWINGS

FIG. 8 is a table for explaining an example 2 of the present invention.

DESCRIPTION OF EMBODIMENTS

Embodiment of the Invention

A flavor inhaler 1 according to an embodiment of the present invention will be described with reference to FIG. 1 to FIG. 6.

Figure 1:
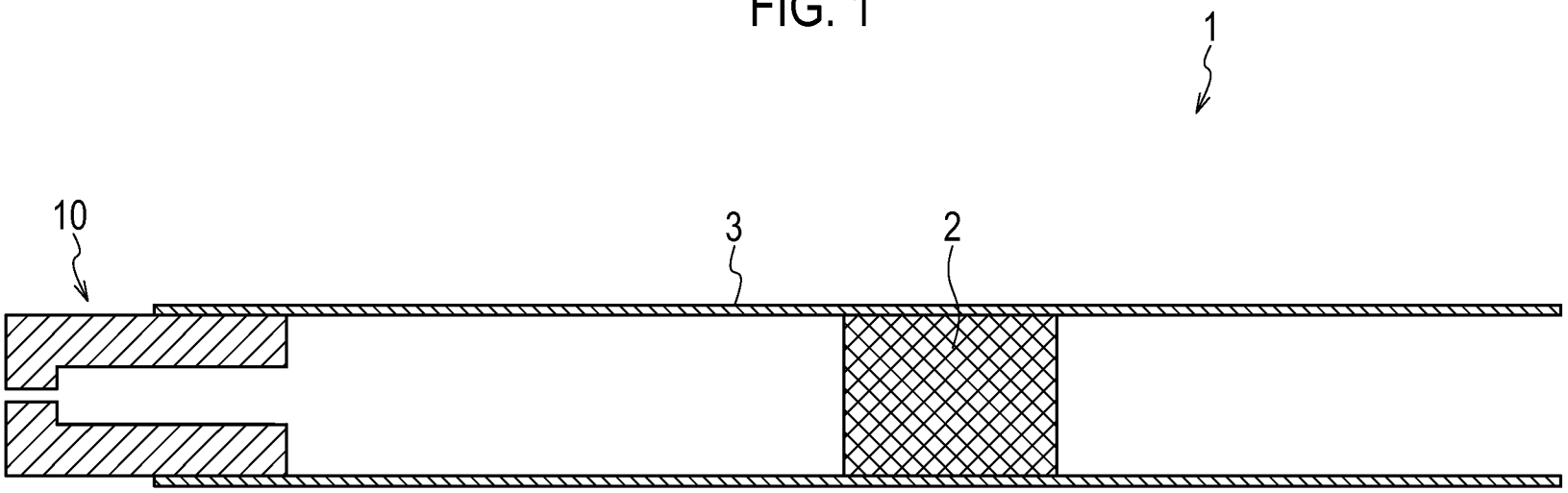
FIG. 1 is a view of a flavor inhaler having a carbon heat source according to an embodiment of the present invention.
Figure 2:
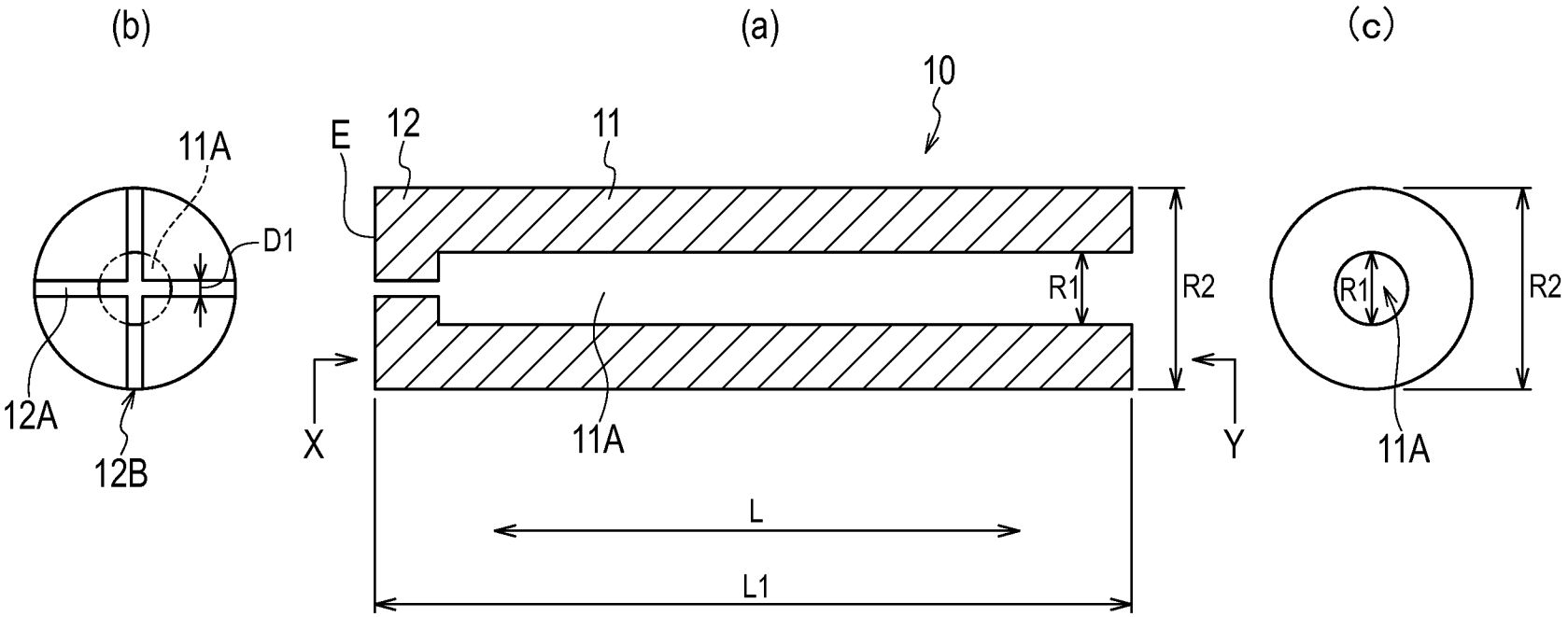
FIG. 2 is a view of the carbon heat source according to the embodiment of the present invention.

FIG. 1 is a view of a flavor inhaler 1 according to the embodiment seen from a lateral direction. FIG. 2 (*a*) is a view of a carbon heat source 10 according to the embodiment seen from a lateral direction Z. FIG. 2 (*b*) is a view of a carbon heat source 10 according to the embodiment seen from an ignition surface direction X. FIG. 2 (*c*) is a view of a carbon heat source 10 according to the embodiment seen from a direction Y on the opposite side (an end face of a puff side) of an ignition surface E.

As shown in FIG. 1, the flavor inhaler 1 according to the embodiment includes a flavor generating source 2, a carbon heat source 10, and a holder 3 for holding the flavor generating source 2 and the carbon heat source 10.

The flavor generating source 2 releases a flavor by transmission of heat generated by the carbon heat source 10.

As a flavor generating source 2, for example, a tobacco leaf can be used. It is possible to use tobacco material, such as, general cut filter tobacco used for a cigarette, granular tobacco used for snuff, roll tobacco, and molded tobacco. A carrier made of porous or non-porous material may be used as the flavor generating source 2.

The roll tobacco is obtained by forming sheet-like regenerated tobacco into a roll, and has a flow path inside. The molded tobacco is obtained by molding granular tobacco.

The tobacco material or the carrier used as the flavor generating source 2 may contain a desired flavor.

The holder 3 may be configured by a paper tube that is formed as a hollow cylindrical body by cylindrically curving a rectangular cardboard and combining both side edge portions.

The carbon heat source 10 and the flavor generating source 2 may be configured not adjacent by providing a gap or by placing a nonflammable member having air permeability between the carbon heat source 10 and the flavor generating source 2.

Further, as shown FIG. 1, it is possible to improve visibility of a burning state of the carbon heat source 10 by protruding at least a part of the carbon heat source 10 from the holder 3.

Figure 3:
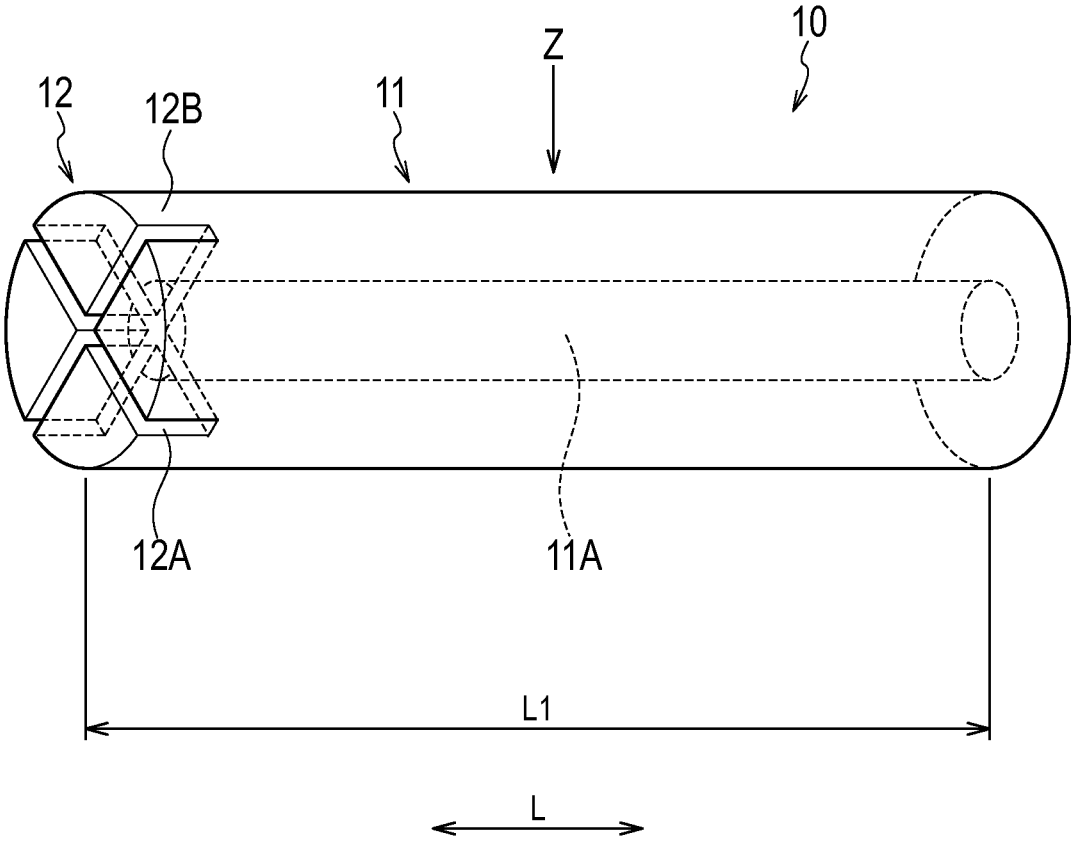
FIG. 3 is a view of the carbon heat source according to the embodiment of the present invention.

As shown in FIG. 2 and FIG. 3, the carbon heat source 10 has a circular column shape, and comprises a circular cylinder portion 11 and an ignition side end portion 12.

As shown in FIG. 2 (*a*), the circular cylinder portion 11 is provided with a cavity 11 for ventilating and communicating in the longitudinal axis direction L of the carbon heat source 10.

Further, as shown in FIG. 2 (*c*), the cavity 11A may have a coaxial circular column shape, having a central axis that is the same as a central axis of the circular cylinder portion 11 over the entire length of the carbon heat source 10. In such a case, a process of manufacturing the cavity 11A can be simplified.

It is preferable to reduce a contact area between a burning portion and inlet air during a puff for supplying a stable amount of heat in a period of middle to late of a puff, that is, for suppressing a fluctuation between a calorific value during natural burning (non-smoking) and a calorific value during a puff.

Therefore, it is possible to suppress a fluctuation between a calorific value during natural burning and a calorific value during a puff by making a cylindrical shape having only a single cavity 11A as shown in FIG. 2 (*a*).

As for a difference (the wall thickness of the circular cylinder portion 11) between a diameter R1 of the cavity 11A and an outer diameter R2 of the carbon heat source (the circular cylinder portion 11), a numeric value for obtaining sufficient ignitability is appropriately selected according to a carbon mixing ratio or the like of a carbon heat source. The difference may be 1 mm or more, preferably 1.5 mm or more, more preferably 2.0 mm or more. In such a configuration, the user can inhale flavor by a sufficient number of times.

The diameter R1 of the cavity 11A may be configured to be 1.5 mm or more, more preferably 2.0 mm or more. In such a configuration, it is possible to reduce a pressure loss to occur during inhalation.

Alternately, the cavity 11A may have a shape with a different diameter along the longitudinal axis direction L, as a conical shape or the like. In such a case, it is possible to precisely control the amount of heat to be supplied in a period of middle to late of a puff.

As shown in FIG. 2 (*a*), the ignition end portion 12 is provided on the ignition side (the ignition surface E) than the circular cylinder portion 11. The ignition end portion 12 has a void that communicates with the cavity 11A in the extending direction of the cavity 11A provided in the circular cylinder portion 11. In the first embodiment, the void of the ignition end portion 12 has a diameter smaller than that of the cavity 11A. The void in the ignition end portion 12 may have a diameter equal to that of the cavity 11A.

As shown in FIG. 2 (*b*) and FIG. 3, on the ignition surface E of the ignition end portion 12, a groove 12A is formed in communication with the cavity 11A. It is to be noted that the groove 12A is formed separately from a cavity in the ignition end portion 12. In other words, a cavity is formed along the longitudinal axis direction L over the entire length of the carbon heat source, and in the case that the cavity is exposed to the ignition end E, the cavity exposed to the ignition end E does not correspond to the groove 12A. In such a configuration, as "the area of the ignition surface E (except for the area of the part provided with the groove 12A)" is reduced and "the area of the groove wall in the groove 12A" is increased, the heat of an ignition source such as a lighter is efficiently transmitted to the ignition end portion, and good ignitability can be obtained in a period from a start of burning to an initial puff.

In other words, to obtain sufficient ignitability, it is desirable to increase the ratio of "the area of the groove wall of the groove 12A" to "the area of the ignition surface E (except for the area of the part provided with the groove 12A)", and "the area of the groove wall of the groove 12A"/"the area of the ignition surface E (except for the area of the part provided with the groove 12A)".

For the ratio of "the area of the groove wall of the groove 12A" to "the area of the ignition surface E (except for the area of the part provided with the groove 12A)", a numeric value for obtaining sufficient ignitability is appropriately selected according to a carbon mixing ratio or the like of the carbon heat source. Sufficient ignitability can be obtained at a value of 0.5 or more, preferably 1.25 or more, more preferably 2.5 or more, for example.

Figure 5:
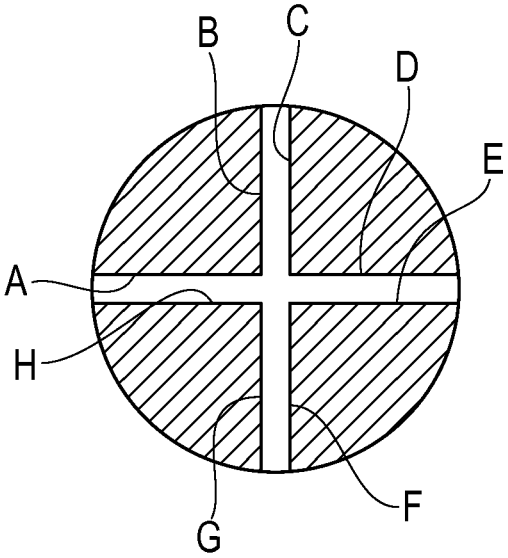
FIG. 5 is a view showing an example of the groove formed on the ignition surface of the carbon heat source according to the embodiment of the present invention.

"The area of the ignition surface E (except for the area of the part provided with the groove 12A)" mentioned here is an area of the shaded part shown in FIG. 5, and "the area of the groove wall of the groove 12A" is an area to be calculated by "the entire length of the groove 12A in the ignition surface E (the total of the lengths of eight sides of A to H shown in FIG. 5)"×"the depth of the groove 12A".

The groove 12A may be arbitrarily arranged as long as it has a shape communicating with the cavity 11A.

For example, as shown in FIG. 2 (*a*) and FIG. 3, the groove 12A may be exposed to a side surface 12B of the ignition end portion 12. In such a configuration, the sidewall of the groove 12A can be burnt more efficiently in a period from a start of burning to an initial puff, and the ignitability is further improved.

Figure 4:
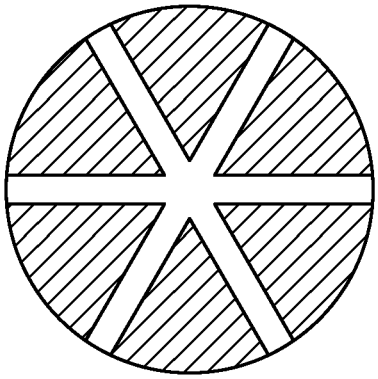
FIG. 4 is a view showing an example of a groove formed on an ignition surface of the carbon heat source according to the embodiment of the present invention.

Further, as shown in FIG. 2 (*b*), two grooves 12A may be arranged to be orthogonal to each other on the ignition surface E. As shown in FIG. 4, three grooves 12A may be arranged to be orthogonal to each other on the ignition surface E.

By arranging two or more grooves 12A so as to divide equally the ignition surface E, it is possible to transmit heat evenly and efficiently to the entire ignition surface E during a period from a start of burning to an initial puff.

The groove 12A may be arranged as a curved shape. As long as each groove communicates with the cavity 11A, two or more grooves 12A may be arranged so as to intersect at a position other than the center of the cavity 11A.

Further, the groove 12A may be inclined to become deeper toward the cavity 11A.

By intersecting two or more curved grooves 12A or linear grooves 12A at various positions within the ignition surface E, a plurality of projected shapes may be provided on the ignition surface E.

By making the depth of the groove 12A deeper, the area of the airflow path in the ignition end portion is increased, and the ignitability can be improved.

For improving the ignitability, although the effect is less than the groove 12A, from the viewpoint of design or the like, the present invention includes, of course, making a groove or the like not communicating with the cavity 11A as well as the groove 12A.

Further, it is possible to prevent a lack in the ignition surface E by chamfering the ignition surface E.

The carbon heat source 10 (the circular cylinder portion 11 and the ignition side end portion 12) may be integrally molded by a method of extrusion, tableting, press casting or the like as described later.

Further, the length L1 in the longitudinal axis direction L of the carbon heat source 10 may be configured to be 8 to 30 mm, preferably 10 to 30 mm, more preferably 10 to 15 mm. The carbon heat source 10 having such a configuration can be suitably employed as a heat source of a flavor inhaler.

The outer diameter R2 of the carbon heat source 10 may be configured to be 4 to 8 mm, more preferably 5 to 7 mm. The carbon heat source 10 having such a configuration can be suitably employed as a heat source of a flavor inhaler.

The outer diameters of the circular cylinder portion 11 and the ignition end portion 12 are configured to be the same as the outer diameter R2 of the carbon heat source 10.

The length of the circular cylinder portion 11 in the longitudinal axis direction L can be arbitrarily set within a range not to impair the function (ignitability) of the ignition end portion 12. For example, the length of the circular cylinder portion 11 in the longitudinal axis direction L may be a length obtained by subtracting the depth of the above groove 12A from the entire length of the carbon heat source 10 in the longitudinal axis direction L.

Hereinafter, an example of a method of manufacturing the carbon heat source 10 according to the embodiment will be explained by referring to FIG. 6.

Figure 6:
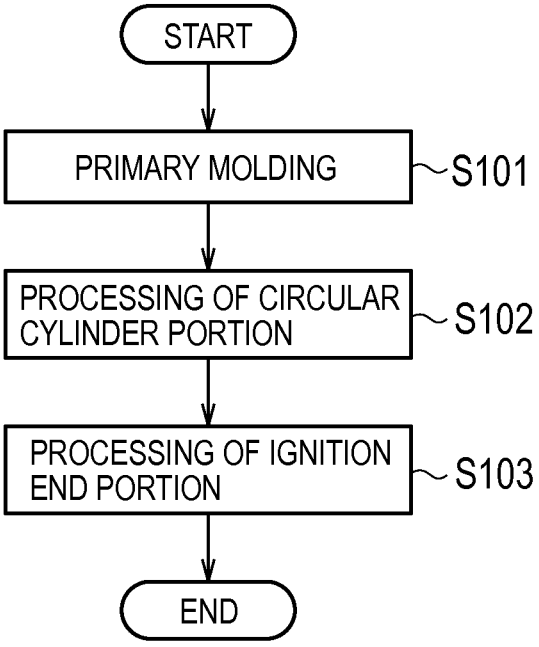
FIG. 6 is a flowchart for explaining a method of manufacturing a carbon heat source 10 according to the embodiment of the present invention.

As shown in FIG. 6, in step S101, primary molding of the carbon heat source 10 is performed.

In the primary molding, the carbon heat source 10 may have a circular column shape without the cavity 11A or a circular column shape with the cavity 11A for ventilating and communicating in the longitudinal axis direction.

The carbon heat source 10 can be obtained by integrally molding a mixture containing water, carbon material derived from plants, nonflammable additive or binder (organic binder or inorganic binder) or the like by a method of extrusion, tableting, press casting or the like.

As such a carbon material, it is desirable to use one obtained by removing volatile impurities by heat treatment or the like.

The carbon heat source 10 can contain a carbon material in a range of 10 wt % to 99 wt %. From the standpoint of supplying a sufficient amount of heat and burning characteristics such as tight ash, the carbon heat source 10 preferably contains a carbon material of 30 wt % to 70 wt %, more preferably a carbon material of 40 wt % to 50 wt %.

As an organic binder, it is possible to use a mixture containing at least one of the CMC (carboxymethyl cellulose), CMC-Na (carboxymethyl cellulose sodium), alginates, EVA, PVA, PVAC and sugars.

As an inorganic binder, it is possible to use, for example, a mineral binder such as mineral purified bentonite, or a silica-based binder such as colloidal silica, water glass and calcium silicate.

For example, from the viewpoint of flavor, the above binder preferably contains CMC or CMC-Na of 1 wt % to 10 wt %, more preferably CMC or CMC-Na of 1 wt % to 8 wt %.

As a nonflammable additive, it is possible to use oxides or carbonates composed of sodium, potassium, calcium, magnesium, silicon, or the like. The carbon heat source 10 can contain a nonflammable additive of 40 wt % to 89 wt %.

It is preferable to use calcium carbonate as a nonflammable additive, and the carbon heat source 10 preferably contains a nonflammable additive of 40 wt % to 55 wt %.

The carbon heat source 10 may contain alkali metal salts such as sodium chloride at a ratio of 1 wt % or less for the purpose of improving the burning characteristics.

In step S102, processing of forming the circular cylinder portion 11 is performed. For example, the circular cylinder portion 11 having the cavity 11A is formed by making a hole up to a predetermined position with a drill in one end face (the puff side end face) of the primarily molded carbon heat source 10.

In step S103, processing of forming the ignition end portion 12 is performed. For example, a groove 12A is formed by performing predetermined processing on the surface (ignition surface) opposite to the surface (puff side end face) where a drill is inserted in step S102, by means of a diamond cutting disc.

Good ignitability can be obtained by appropriately adjusting the number, depth or width of the groove 12A in accordance with the composition (carbon blended rate, or the like) and outer diameter R2 of the carbon heat source 10.

The order of steps S102 and S103 may be reversed. When the cavity 11A has been formed in the primary molding, step S102 may be omitted.

In the flavor inhaler 1 and the carbon heat source 10 according to the embodiment, it is possible to satisfy good ignitability on the ignition surface E and stable heat supply in the circular cylinder portion 11 at the same time by forming the groove 12A on the ignition surface E and forming the cavity 11A for ventilating and communicating in the longitudinal axis direction L of the carbon heat source 10 in the circular cylinder portion 11.

Example 1

A test performed for evaluating the relationship between the ignitability and the shape of the groove 12A in the ignition surface E will be explained with reference to FIG. 7.

In the test, a plurality of test samples A-1 to E-3 has been prepared. Table 1 shows the number, width and depth of the groove 12A in the test samples A-1 to E-3.

First, activated carbon of 100 g, calcium carbonate of 90 g, and CMC of 10 g (degree of etherification 0.6) have been mixed, then water of 270 g containing sodium chloride of 1 g has been added and mixed further.

Second, the mixture has been kneaded, and then extrusion molding has been performed to make a circular column shape with an inner diameter of 0.7 mm and an outer diameter of 6 mm.

Third, the molded product obtained by the extrusion molding has been dried, and then cut to a length of 13 mm, and a primarily molded body (the carbon heat source 10 of the primary molding) has been obtained.

Fourth, the circular cylinder portion 11 having the cavity 11A has been formed by making a hole up to a predetermined position in one end face (puff side end face) of the primarily molded body, by using a drill with a diameter of 2 mm.

Fifth, the groove 12A has been formed by performing predetermined processing on the surface (ignition surface) opposite to the surface (puff side end face) where a drill has been inserted in step S102, by means of a diamond cutting disc.

Then, an ignitability evaluation test has been performed for each test sample A-1 to E-3 (the carbon heat source 10) by the following method.

Figure 7:
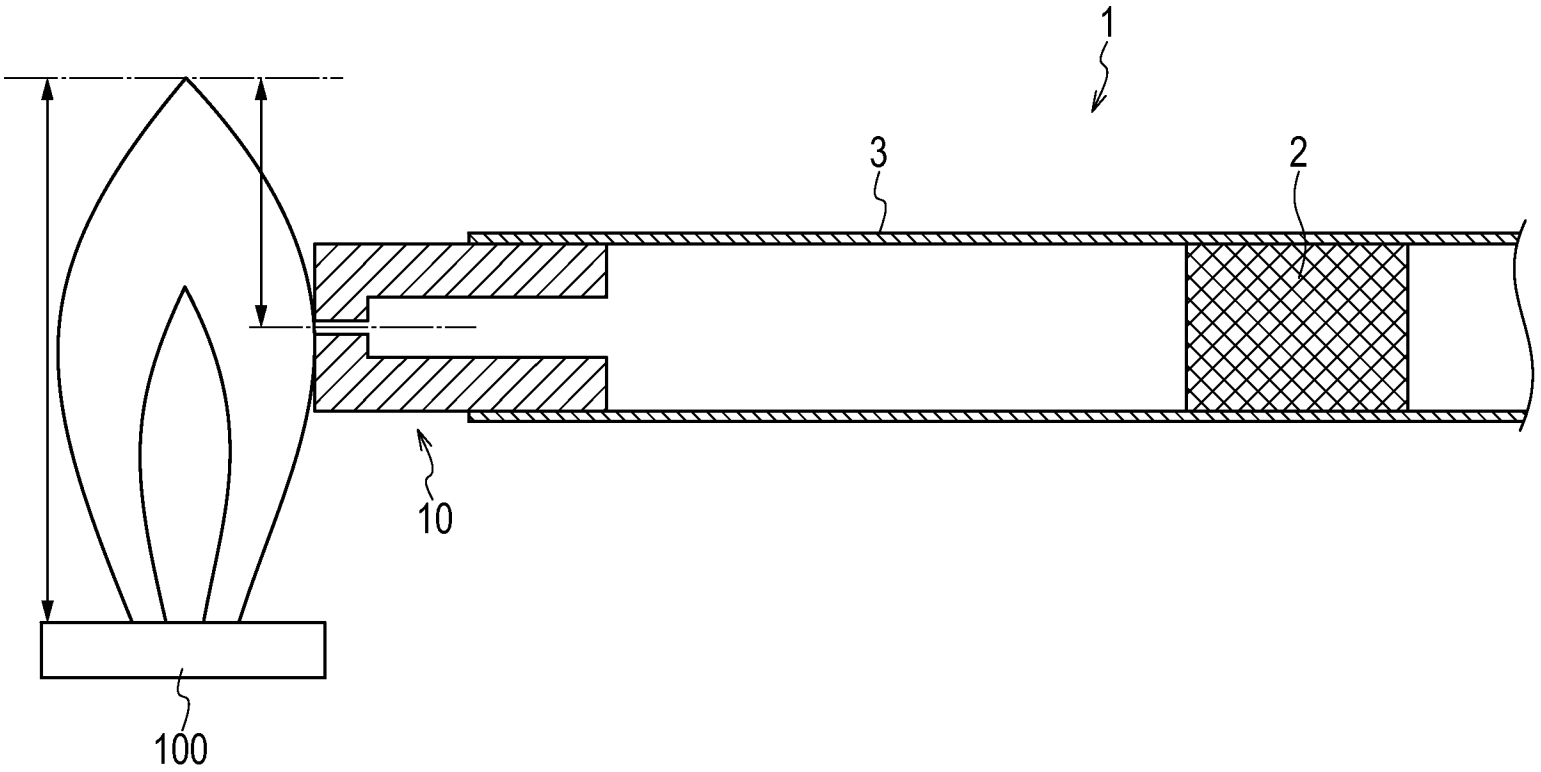
FIG. 7 is a view for explaining an example 1 of the present invention.

First, as shown in FIG. 7, the circular cylinder portion 11 of each test sample A-1 to E-3 (the carbon heat source 10) has been connected to the holder 3 made of a paper tube.

Second, each test sample (the carbon heat source 10) has been heated for three seconds by bringing into contact with the flame of a commercially available gas lighter 100, then a puffed of 55 ml/2 seconds have been performed. The puff has been repeated at 15 second intervals.

Table 1 shows the result of the ignitability evaluation test for each test sample A-1 to E-3.

TABLE 1

| Sample | Outer diameter R2 of carbon heat source [mm] | Groove width [mm] | Groove depth [mm] | Number of grooves | Area ratio of groove wall with respect to ignition surface | Burning area after 1st puff (○: Whole, Δ: Part) | Burning continuation after 2nd puff (○: Continued, X: Not continued) |
|---|---|---|---|---|---|---|---|
| A-1 | 5.7 | 1 | 1 | 2 | 1.22 | Δ | X |
| A-2 | 5.7 | 1 | 1 | 2 | 1.22 | Δ | X |
| A-3 | 5.7 | 1 | 1 | 2 | 1.22 | Δ | X |
| B-1 | 5.7 | 1 | 2 | 2 | 2.43 | ○ | ○ |
| B-2 | 5.7 | 1 | 2 | 2 | 2.43 | ○ | ○ |
| B-3 | 5.7 | 1 | 2 | 2 | 2.43 | ○ | ○ |
| C-1 | 5.7 | 1 | 3 | 2 | 3.65 | ○ | ○ |
| C-2 | 5.7 | 1 | 3 | 2 | 3.65 | ○ | ○ |
| C-3 | 5.7 | 1 | 3 | 2 | 3.65 | ○ | ○ |
| D-1 | 5.7 | 1 | 1 | 1 | 0.57 | Δ | X |
| D-2 | 5.7 | 1 | 1 | 1 | 0.57 | Δ | X |
| D-3 | 5.7 | 1 | 1 | 1 | 0.57 | Δ | X |
| E-1 | 5.7 | 1 | 1 | 3 | 2.69 | Δ | ○ |
| E-2 | 5.7 | 1 | 1 | 3 | 2.69 | Δ | ○ |
| E-3 | 5.7 | 1 | 1 | 3 | 2.69 | Δ | X |

Here, as an ignitability evaluation test, we have confirmed "a burning state of the ignition surface of each test sample after a first puff (whether or not the whole ignition surface burns)" and whether "the burning continues after a second puff (whether the burning continues uniformly)".

According to the results of the evaluation test, it is confirmed that when the number of the grooves 12A is "two", sufficient ignitability is obtained even with a commercially available gas lighter 100 by making the depth of the groove 12A of "2 mm or more".

Further, even when the depth of the groove 12A is "1 mm", the ignitability has been improved by making "three or more" numbers of grooves 12A.

Further, according to the results of the evaluation test, it is proved that the ignitability is improved as the ratio of the groove wall in the groove 12A to the area ratio of the groove wall with respect to the ignition surface (the area of the ignition surface E (except for the area of the part where the groove 12A is formed)) is greater.

The groove depth mentioned here means a distance from the ignition surface E to the bottom of the groove 12A in the longitudinal axis direction L. The groove width means a size of the groove 12A in the direction orthogonal to the extension direction of the groove 12A on the ignition surface E.

Example 2

Hereinafter, an example 2 will be explained. In the example 2, a plurality of samples (samples L-1 to M-2) shown in FIG. 8 are prepared, and confirmed were a temperature difference between puffs and the puff number that continue burning.

Each sample is a carbon heat source composed of activated carbon, calcium carbonate, and CMC. When the total weight of a sample is 100 wt % or more, a sample is composed of activated carbon of 80 wt %, calcium carbonate of 15 wt %, and CMC of 5 wt %. The length of each sample in the longitudinal axis direction L is 15 mm FIG. 8 shows the number of cavities of each sample, the size of a cavity, and the number of cavities.

Such a sample has been inserted into a paper tube, and a puff of 55 ml/2 seconds has been performed after bringing an ignition end into contact with the flame of commercially available light for three seconds.

As shown in FIG. 8, compared with the samples M-1 to M-2 having a plurality of cavities, the samples L-1 to L-3 having a single cavity can provide good results in both the temperature difference between puffs and the burning continued puff number.

In other words, compared with the case that a plurality of cavities is provided, when a single cavity is provided, "a molded body cross-sectional area/flow path perimeter" is great, and reduction of the temperature difference between pulls has been confirmed. Further, as compared with the case that a plurality of cavities is provided, when a single cavity is provided, "a molded body cross-sectional area/flow path perimeter" is great, and an increase in the puff number has been confirmed.

(Modification 1)

Hereinafter, a modification 1 of the embodiment described above will be explained. Differences from the embodiment described above will be explained.

Figure 9:
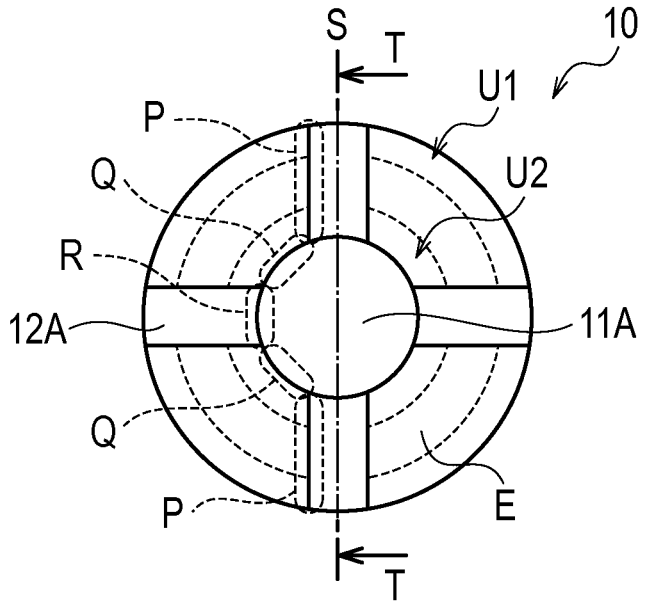
FIG. 9 is a view illustrating a carbon heat source according to a modification 1 of the present invention.
Figure 10:
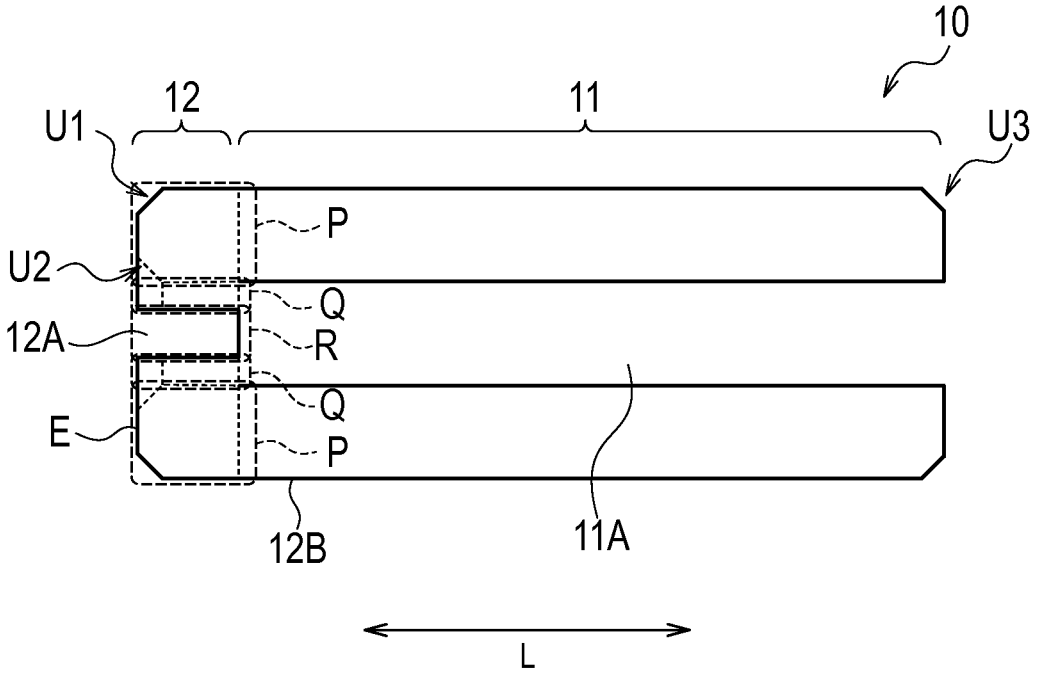
FIG. 10 is a view of the carbon heat source according to a modification 1 of the present invention.

FIG. 9 and FIG. 10 show a carbon heat source 10 according to the modification 1. FIG. 9 is a view of the carbon source 10 seen from the end face (hereinafter, an ignition surface E) on the ignition side. FIG. 10 is a view of the cross section S shown in FIG. 9 seen from the T side. The cross section S is a section passing through the center of the cavity 11A and the groove 12A. In FIG. 10, for convenience of description, it should be noted that the ridge line seen on the front side is indicated by a dotted line. P, Q and R show the same portions as illustrated in FIGS. 9 and 10.

As shown in FIG. 9, the ignition surface E of the carbon heat source 10 is provided with a cross-shaped groove 12A passing through the center of the cavity 11A.

In the modification 1, the ignition end portion 12 has a void communicating with the cavity 11A in the extending direction of the cavity 11A provided in the circular cylinder portion 11. In the modification 1, the void in the ignition end portion 12 has the same diameter as that of the cavity 11A. It should be noted that the cross-shaped groove 12A is formed separately from the void in the ignition end portion 12.

As described in the above embodiment, chamfering may be given to the ignition surface E. For example, as shown in FIG. 9 and FIG. 10, chamfering has been given to the outer end U1 in the radial direction of the ignition surface E. Chamfering has been given to the inner end U2 in the radial direction of the ignition surface E. Chamfering has been given to the outer end U3 in the radial direction of the non-ignition end provided on the opposite side of the ignition surface E. In other words, the outer end U1, inner end U2 and outer end UE have a tilt with respect to a vertical plane relative to the longitudinal axis direction L. By such chamfering, a lack of the carbon heat source 10 is suppressed.

The diameter of the cavity 11A is 2.5 mm for example. The groove width of each groove 12A is smaller than the diameter of the cavity 11A, for example, 1 mm. The length of the carbon heat source 10 in the longitudinal axis direction L is 17 mm for example. The length of the ignition end portion 12 in the longitudinal axis direction L is 2 mm for example. Of the ignition end portion 12, the length of the part where chamfering is performed is 0.5 mm for example. In other words, in the longitudinal axis direction, of the ignition end portion 12, the length of the part where chamfering is not performed is 1.5 mm.

In the modification 1, it should be noted that the carbon heat source 10 (the circular cylinder portion 11 and the ignition end portion 12) is integrally molded. For example, after molding a lump body that is composed of a carbon material and has a cavity extending along the longitudinal axis direction by a method of extrusion, tableting or press casting, a groove may be formed by cutting the ignition end face.

(Modification 2)

Figure 11:
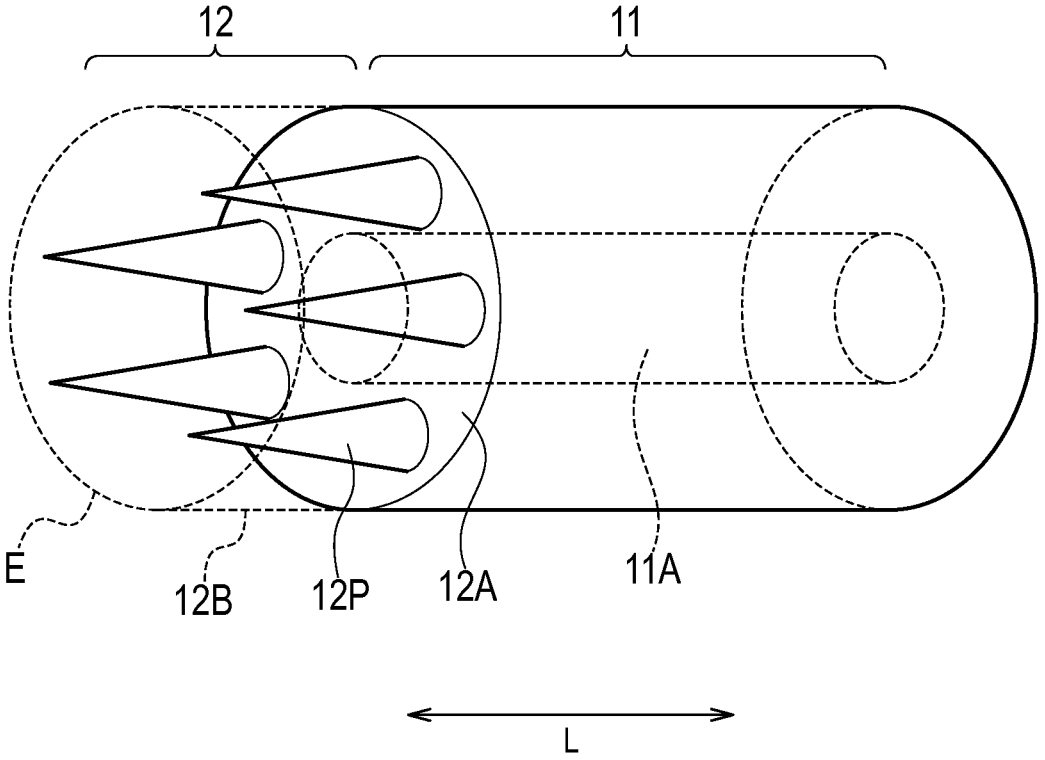
FIG. 11 is a view of a carbon heat source according to a modification 2 of the present invention.

Hereinafter, a modification 2 of the embodiment described above will be explained. Differences from the embodiment described above will be explained. FIG. 11 is a view of a carbon heat source 10 according to the modification 2. In FIG. 11, for convenience of description, an outer profile of the ignition end portion 12 is virtually shown in dotted lines by extending the outer profile of the circular cylinder portion 11 along the longitudinal axis direction L.

As described in the aforementioned, a plurality of projections may be formed on the ignition surface E. As shown in FIG. 11, the ignition end portion 12 has a plurality of projections 12P. The tips of the projections 12P constitute an ignition surface E. The above mentioned groove 12B is a pace between the projects 12P adjacent each other.

Although the present invention has been described in detail by using the embodiments described hereinbefore, it is apparent that the invention is not to be limited to the embodiments explained in this specification. The invention may be embodied in various modifications and alterations without departing from the spirit and scope of the invention defined in terms of the claims, and thus, the description of the specification is to be considered as illustrative and not intended to have any restrictive meaning to the present invention.

For example, the carbon heat source 10 has a circular column shape in the embodiments, but the embodiments are not limited thereto. The carbon heat source 10 may have a rectangular column shape. In the embodiments, the cavity 11A has a circular shape in the cross section orthogonal to the longitudinal axis direction L, but the embodiments are not limited thereto. The cavity 11A may have a rectangular shape or an elliptical shape in a cross section orthogonal to the longitudinal axis direction L. In such a case, the diameter R1 of the cavity 11A and the outer diameter R2 of the carbon heat source 10 may be read as a size in the direction orthogonal to the longitudinal axis direction L. In such a case, the size in the direction orthogonal to the longitudinal axis direction L may be a maximum length, a minimum length, or an average length of a straight line passing through the center of the carbon heat source 10 (the cavity 11A) in the cross section perpendicular to the longitudinal axis direction L.

As a reference, the entire content of Japanese Patent Application No. 2012-083184 (filed on Mar. 30, 2012) is incorporated herein.

INDUSTRIAL APPLICABILITY

As described hereinbefore, according to the present invention, it is possible to provide a carbon heat source and a flavor inhaler, which have good ignitability in a period from a start of burning to an initial puff, and can realize supply of stable amount of heat in a period of middle to late of a puff.

The invention claimed is:

1. A flavor inhaler including a columnar carbon heat source, comprising:

a cylindrical portion provided with a cavity for ventilating and communicating in a longitudinal axis direction of the carbon heat source; and an ignition end portion provided on an ignition side of the carbon heat source, wherein a groove communicating with the cavity is formed on an end face of the ignition end portion on the ignition side, the ignition end portion has a void that communicates with the cavity in an extending direction of the cavity provided in the cylindrical portion, and the groove is formed separately from the void and said groove is exposed to a side surface of the ignition end portion.

2. The flavor inhaler according to claim 1, wherein the cylindrical portion has a circular cylinder shape, and a difference between a diameter of the cavity and an outer diameter of the carbon heat source is configured to be 1 mm or more.

3. The flavor inhaler according to claim 1, wherein the cylindrical portion and the ignition end portion are integrally molded.

4. The flavor inhaler according to claim 1, wherein:
a size of the carbon heat source is configured to be 10 mm to 30 mm in the longitudinal axis direction of the carbon heat source, and
a size of the carbon heat source is configured to be 4 mm to 8 mm in a direction orthogonal to the longitudinal axis direction.

5. The flavor inhaler according to claim 1, wherein:
a size of the cavity is configured to be 1 mm to 4 mm in a direction orthogonal to the longitudinal axis direction of the carbon heat source.

6. The flavor inhaler according to claim 2, wherein the cylindrical portion and the ignition end portion are integrally molded.

7. The flavor inhaler according to claim 2, wherein:
a size of the carbon heat source is configured to be 10 mm to 30 mm in the longitudinal axis direction of the carbon heat source, and
a size of the carbon heat source is configured to be 4 mm to 8 mm in a direction orthogonal to the longitudinal axis direction.

8. The flavor inhaler according to claim 3, wherein:
a size of the carbon heat source is configured to be 10 mm to 30 mm in the longitudinal axis direction of the carbon heat source, and
a size of the carbon heat source is configured to be 4 mm to 8 mm in a direction orthogonal to the longitudinal axis direction.

9. The flavor inhaler according to claim 2, wherein:
a size of the cavity is configured to be 1 mm to 4 mm in a direction orthogonal to the longitudinal axis direction of the carbon heat source.

10. The flavor inhaler according to claim 3, wherein:
a size of the cavity is configured to be 1 mm to 4 mm in a direction orthogonal to the longitudinal axis direction of the carbon heat source.

11. The flavor inhaler according to claim 4, wherein:
a size of the cavity is configured to be 1 mm to 4 mm in a direction orthogonal to the longitudinal axis direction of the carbon heat source.

12. A columnar carbon heat source, comprising:
a cylindrical portion provided with a cavity for ventilating and communicating in a longitudinal axis direction of the carbon heat source; and
an ignition end portion provided on an ignition side of the carbon heat source, wherein
a groove communicating with the cavity is formed on an end face of the ignition end portion on the ignition side,
the ignition end portion has a void that communicates with the cavity in an extending direction of the cavity provided in the cylindrical portion,
the groove is formed separately from the void,
the groove is exposed to a side surface of the ignition end portion,
the cylindrical portion has a circular cylinder shape,
a difference between a diameter of the cavity and an outer diameter of the carbon heat source is configured to be 1 mm or more,
the cylindrical portion and the ignition end portion are integrally molded,
a size of the carbon heat source is configured to be 10 mm to 30 mm in the longitudinal axis direction of the carbon heat source,
a size of the carbon heat source is configured to be 4 mm to 8 mm in a direction orthogonal to the longitudinal axis direction, and
a size of the cavity is configured to be 1 mm to 4 mm in a direction orthogonal to the longitudinal axis direction of the carbon heat source.

* * * * *